United States Patent [19]

Corsette

[11] Patent Number: 4,591,077

[45] Date of Patent: May 27, 1986

[54] CONTINUOUS DISCHARGE DISPENSER

[76] Inventor: Douglas F. Corsette, 6559 Firebrand St., Los Angeles, Calif. 90045

[21] Appl. No.: 695,281

[22] Filed: Jan. 28, 1985

[51] Int. Cl.[4] ..... B05B 11/00

[52] U.S. Cl. ..... 222/321; 222/340; 222/380; 222/383; 222/335; 239/322; 239/333

[58] Field of Search ..... 222/340, 380, 383, 321, 222/384, 335; 239/322, 333, 331

[56] References Cited

U.S. PATENT DOCUMENTS

| | | | |
|---|---|---|---|
| 4,050,613 | 9/1977 | Corsette . | |
| 4,079,865 | 3/1978 | Kutik . | |
| 4,109,832 | 8/1978 | Kutik et al. . | |
| 4,146,155 | 3/1979 | Kutik et al. . | |
| 4,174,056 | 11/1979 | Loeffler . | |
| 4,191,313 | 3/1980 | Blake et al. | 222/383 X |
| 4,222,501 | 9/1980 | Hammett et al. . | |
| 4,225,060 | 9/1980 | Kutik et al. | 222/340 X |
| 4,241,853 | 12/1980 | Pauls et al. | 222/383 X |
| 4,325,501 | 4/1982 | Shay | 222/383 X |
| 4,402,432 | 9/1983 | Corsette . | |
| 4,494,680 | 1/1985 | Corsette | 222/383 X |

*Primary Examiner*—Joseph J. Rolla
*Assistant Examiner*—Edward S. Ammeen
*Attorney, Agent, or Firm*—Watson, Cole, Grindle & Watson

[57] ABSTRACT

A dual chamber continuous discharge dispenser includes relatively movable pump piston and pump cylinder during compression and the compression strokes and together defining a variable volume pump chamber which comprises part of an encircling accumulator element which is displaced during the compression stroke for opening the discharge. A wall on the accumulator having a valve-controlled opening prevents return flow of product from an accumulation chamber back into the pump chamber during the discharge of product from the accumulation chamber.

19 Claims, 5 Drawing Figures

CONTINUOUS DISCHARGE DISPENSER

RELATED APPLICATION

This application relates to U.S. patent application Ser. No. 539,965, filed Oct. 7, 1983 by Douglas F. Corsette.

BACKGROUND OF THE INVENTION

The aforementioned related application discloses an alternative approach to my earlier patented dispensing pumps mentioned therein, in the form of a trigger actuated dispenser of the pressure accumulating type in which the discharge is opened upon an accumulation of pump pressure above a predetermined minimum.

This invention relates to a dispenser of the general aforementioned type which by a simple modification is made to continue to discharge product under pressure even after the pumping action on the pump plunger has been completed.

The trigger actuated dispenser disclosed in my aforementioned related application includes a spring biased pump plunger having an inlet check valve and forming a pump piston acting within a pump cylinder defined by an accumulator element in the form of a hollow sleeve having an annular discharge valve thereon. The piston and accumulator define a variable volume pressure pump chamber during plunger reciprocation, and a blind socket formed at one end of the pump body defines with the accumulator an enclosed variable volume pressure accumulation chamber of larger diameter relative to the pump chamber and in direct and open communication therewith. A return spring acts between the plunger and the accumulator for urging the discharge valve closed, and the spring likewise resiliently urges the plunger outwardly of the pump chamber into a container vent closed and sealed position. During the plunger compression stroke the pressure within the accumulation chamber increases which effects a shifting away of the accumulator from the blind socket end of the pump body whereupon the discharge passage opens for effecting a discharge of product under pressure from the pump chamber. The discharge continues until the plunger is released and the reduced pressure in the pump chamber is again overcome by the stored spring force by closing the discharge as the accumulator returns to its original position. And, a sustained discharge of product at regulated pressure is made possible.

And, in my U.S. Pat. No. 4,402,432, a finger actuated dispensing pump includes a stationary valve-controlled piston and a spring-biased sleeve-like accumulator having an annular discharge valve thereon. The piston and accumulator define a variable volume pressure pump chamber during plunger reciprocation, and a blind socket formed at the underside of the plunger head defines with the accumulator an enclosed variable volume pressure accumulation chamber of larger diameter relative to the pump chamber and in direct and open communication therewith. A return spring acts between the pump body and the accumulator for urging the discharge valve closed, and the spring resiliently urges the accumulator into a container vent closed and sealed position. Dispensing takes place under pressure in a manner similar to that described above for my trigger actuated dispenser, and is likewise capable of effecting a sustained discharge. However, at any point where the actuator (trigger, etc.) is released, the accumulator is immediately returned to the discharge closed position because of the chamber pressure drop below operating pressure.

For some dispensing operations, it is desirable to dispense product in a continuous stream or spray even during the recovery movement of the pump plunger. Various approaches have been taken to effect such continuous discharge, as for example those disclosed in U.S. Pat. Nos. 4,079,865, 4,109,832, 4,146,155, 4,174,056 and 4,222,501. However, each of these dispensers requires many parts and rather complicated arrangements which limit the effectiveness during assembly and operation. In each of these continuous sprayers, the pump cylinder is separate from the accumulator or storage compartment piston, which thereby gives rise to a specific dispenser operation and function requiring, for example, separate plunger and accumulator return springs or other resilient means. Moreover, the plunger and accumulator are incapable of operating together as a unit in these prior dispensers during such occasions as may be needed to manually, rather than merely resiliently, overcome the hydraulic pressure in the accumulation chamber to assure proper discharge.

SUMMARY OF THE INVENTION

It is therefore an object of the present invention to convert my sustained discharge dispensers, whether trigger actuated or finger operated, by simple modification into continuous discharge dispensers by the provision of a separator between pump and accumulation chambers, the separator having a one-way valve controlled inlet admitting pressurized product from the pump chamber to the accumulation chamber and preventing a return flow of product to the pump chamber upon the ensuing intake stroke of the pump plunger.

Another object of this invention is to provide such dispenser as having the capability of substantially purging the pump chamber of fluid both during pump priming and during rapid pumping in use, the latter condition permitting the piston and accumulator to operate as a unit for manually overcoming the hydraulic pressure in the accumulation chamber for ensuring the proper and desired discharge of product.

A further object of the invention is to provide such dispenser as capable of purging air to ensure priming from between the separator on the accumulator and a confronting end of the pump bore in which the accumulator operates.

The manually actuated dispensers according to the invention are of essentially the same construction as the pumps disclosed in my aforementioned dispense pumps except for the accumulator element which has an upper separator cap containing a valve controlled opening permitting the continuous discharge even after the plunger is released and re-actuated. The cap and the confronting piston end of the plunger are complementarily contoured to facilitate evacuation of the pump chamber of fluid to effect priming, and the cap and confronting surface at the end of the pump bore are complementarily contoured to likewise effect priming upon evacuation of fluid from therebetween. The matching confronting surfaces between the piston and the accumulator cap result in an empty pump chamber condition of effectively zero volume when the piston "bottoms out" against the accumulator during the plunger pressure stroke, when pumping relatively rapidly, whereupon the piston and accumulator may be operated together as a unit to expel product from the accumulation chamber through the open discharge.

Other objects, advantages and novel features of the invention will become more apparent from the following detailed description of the invention when taken in conjunction with the accompanying drawings.

DETAILED DESCRIPTION OF THE INVENTION

Figure 1:
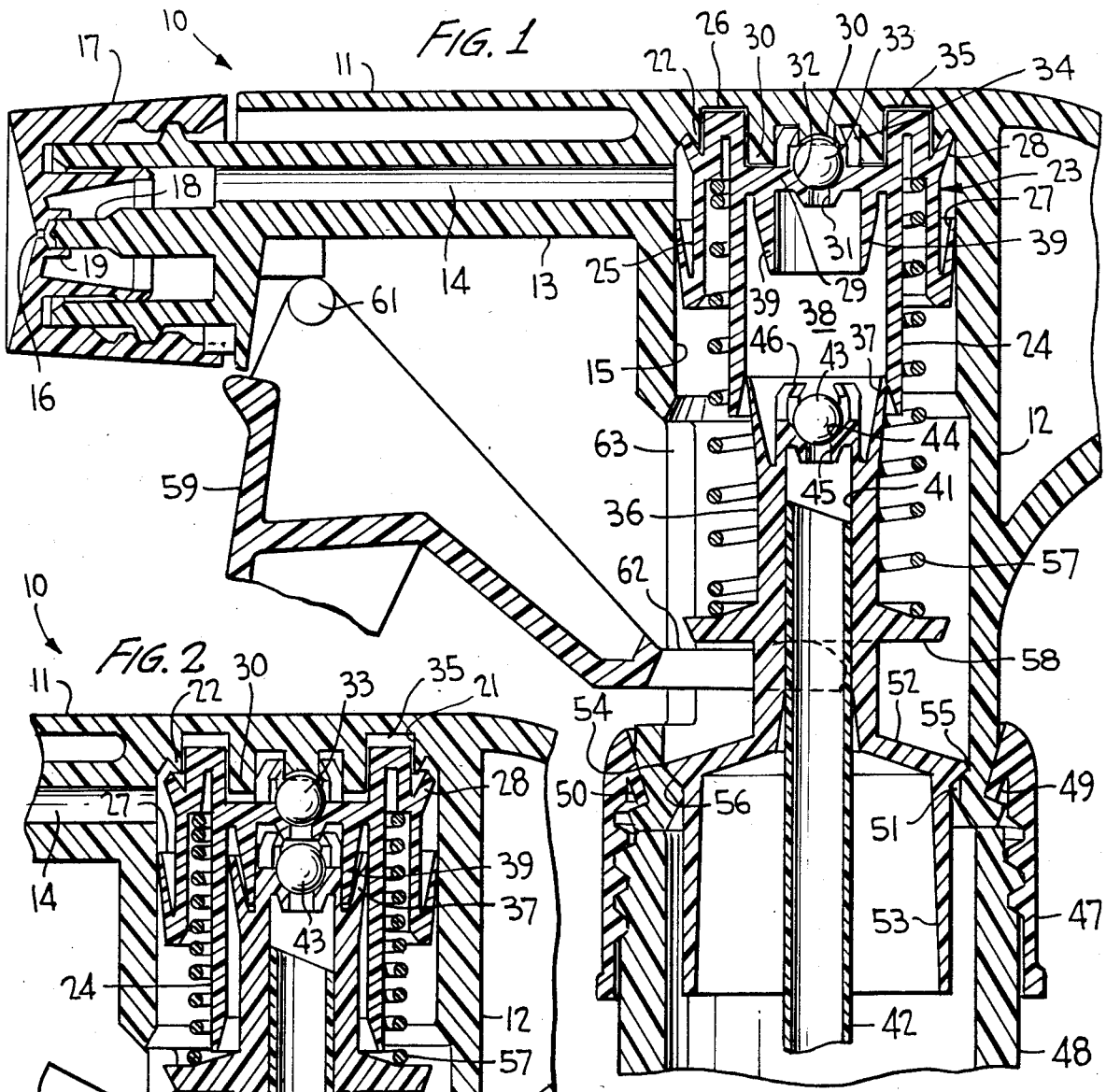
FIG. 1 is a vertical sectional view of a dispenser according to one embodiment of the invention, shown mounted on the neck of a container of flowable product to be dispensed, the pump elements of the dispenser being shown in their at rest position prior to trigger actuation.
Figure 2:
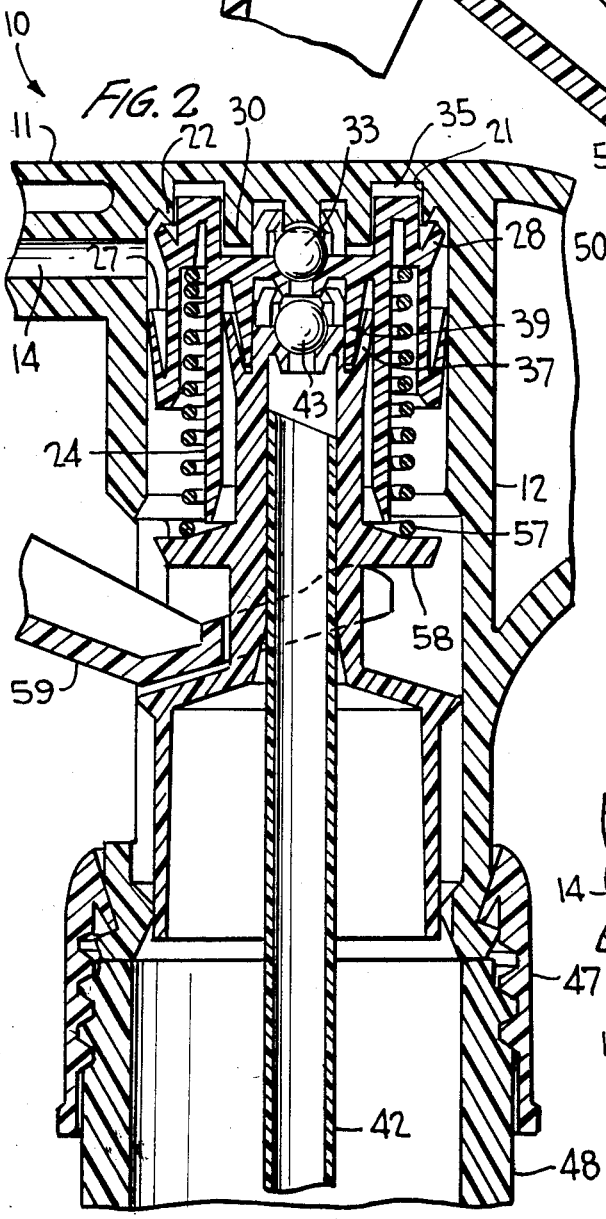
FIG. 2 is a view similar to FIG. 1, in which the piston/plunger is shown at or near the end of its compression stroke with the intake valve closed and the discharge valve open to effect continuous discharge.

Turning now to the drawings wherein like reference characters refer to like and corresponding parts throughout the several views, the trigger actuated dispenser according to one embodiment of the invention is generally designated 10 in FIGS. 1 and 2 and is structured essentially the same as the dispenser of the aforementioned related application except for the accumulator element. However, it will be seen that the operation of the FIGS. 1 and 2 dispenser differs from that of my 539,965 dispenser having no valve controlled separator between the pump and accumulation chambers.

Dispenser 10 comprises a pump body 11 having a cylindrical section 12 containing a bore, and a discharge barrel 13 extending therefrom. The barrel contains a longitudinal discharge passage 14 which opens at its inner end into an interior annular wall 15 of section 12. The terminal end of the discharge passage communicates with a discharge orifice 16 located in a discharge nozzle 17 shown threaded onto the terminal end of barrel 13 in a discharge position. A pin 18 extends from the end of barrel 13 and is coaxial with nozzle 17 so as to be seated within a central cup 19 surrounding the discharge orifice in the discharge position of FIG. 1. The orifice may be opened in a known manner by unthreading the discharge nozzle, and cup 19 may include a swirl chamber for misting.

The discharge barrel end of section 12 of the pump body is formed to provide a downwardly directed blind socket 21 delimited by an annular sealing rib 22. An accumulator element 23 is disposed in body section 12 for sliding displacement along wall 15. The accumulator comprises a cylindrical sleeve 24 defining a pump body cylinder, and a surrounding concentric skirt 25 joined to sleeve 24 by an annular shoulder 26. A packing gland 27 on skirt 25 bears against wall 15 of body section 12 for guiding the accumulator therealong in a fluid tight manner. An annular discharge valve flange 28 is provided near the upper end of skirt 25, and is seated against sealing rib 22 in the discharge closing position of FIG. 1. The accumulator further includes a transverse separator wall 29 near its upper end, the wall containing a one-way valve controlled opening 31 therein defining a valve seat 32 against which a check valve, such as a ball check valve 33, is normally seated. A cage in the form of upstanding fingers 34 surrounds the ball check and limits the movement thereof in a known manner when unseated. The shoulder end of the accumulator and the confronting surface on the pump body are contoured to substantially match in shape, so that the accumulator defines with the blind socket a variable volume pressure accumulation chamber 35. And, extensions 30 on the pump body extend toward the accumulator to match the contour of the confronting accumulator to approximate a near zero intervening volume.

A hollow plunger 36 is mounted for reciprocation within body section 12, and has a piston portion 37 at its upper end extending into sleeve 24 of the accumulator so as to define with the accumulator a variable volume pressure pump chamber 38 which communicates with the accumulation chamber through valve opening 31 only during the plunger compression stroke in which the pressure within pump chamber 38 exceeds the pressure within accumulation chamber 35 sufficiently to unseat check valve 33 from its ball seat. Otherwise, check valve 33 prevents the return of pressurized product from the accumulation chamber back into the pump chamber. And, the underside of wall 29 of the accumulator, including extension 39 thereon, is contoured to substantially match the confronting piston end of the plunger so that when engaged the intervening volume is near zero. As will be described in more detail hereinafter, these matching surfaces between a confronting side of the valved separator wall on the accumulator and the piston and between a confronting side of such wall and the pump body bore, permit unwanted air to be substantially purged from the pump and accumulation chambers through the open discharge passage during priming to thereby improve upon pump priming and operating efficiency. Moreover, the matching contour between the piston and the underside of the valve separator wall reduces the pump chamber volume essentially to zero and will permit the accumulator and the pump plunger to be operated together as a unit when the plunger bottoms out within the pump cylinder for emptying the pump chamber during use when these matching surfaces interengage as shown in FIG. 2. Such a condition will normally occur upon a substantially rapid, hard pumping action such that the plunger and accumulator function together as a unit to manually expel product from the accumulation chamber through the open discharge at a pressure at least greater than that supplied by the accumulator from the regulator spring force alone.

The hollow plunger includes an inlet passage 41 which communicates at its lower end, via a connected dip tube 42, with the interior of the container (not shown) of flowable product to be dispensed. The flow of product through the inlet passage is controlled by a check valve which may be in the form of a ball check 43 normally seated against an inlet valve seat 44 surrounding a valve opening 45 at the upper end of the inlet passage. A cage in the form of detents or upstanding fingers 46 surrounds the ball check and limits the movement thereof in a normal manner when unseated. Of course, either or both check valves 43 and 33 could be in the form of an integral, self-hinged valve similar to that disclosed in my U.S. Pat. No. 4,050,613, without departing from the invention.

The pump body is adapted to be secured in fluid tight communication with the opening of the container of flowable product to be dispensed. For this purpose a container closure cap 47 which may be internally threaded or otherwise arranged for securing it in a liquid tight manner engages neck 48 of the container which is similarly threaded, and has an annular inwardly directed flange 49 at its upper end in engagement with a mating groove 50 provided around the periphery of body section 12 for fixing the dispenser body onto the container neck.

An annular shoulder 52 on the plunger has an annular skirt 53 depending therefrom, and an annular vent valve 54 extending radially outwardly of the skirt. In the at rest position of FIG. 1, this valve bears against a vent seat 55 defined by the upper side of an annular and inwardly extending rim 56. A container vent extending between opposite sides of this rim may be in the form of a groove 51 which permits equalization of pressure within and outside the container, and which permits return to the container of any flowable product which may leak or seep past the plunger, similarly as described with reference to the aforementioned related application.

A coil return spring 57 extends between the accumulator and an abutment on the plunger which may also serve as a plunger lift flange 58 on the plunger for resiliently urging the accumulator into a discharge closed and sealed position and the plunger into a vent valve closed and sealed position, as shown in FIG. 1. And, a trigger actuator 59 (only partially shown) is provided for manually actuating the plunger, the trigger being hingedly mounted on the pump body as at 61, and having a forked end 62 extending through an opening 63 in the pump body for engagement with the underside of lift flange 58. And, the pump body has a support piece (shown broken away in the drawings) for the operator's hand when gripping section 12 during pumping.

Alternative container vent valving arrangements are made possible as shown in the aforementioned related application.

Figure 3:
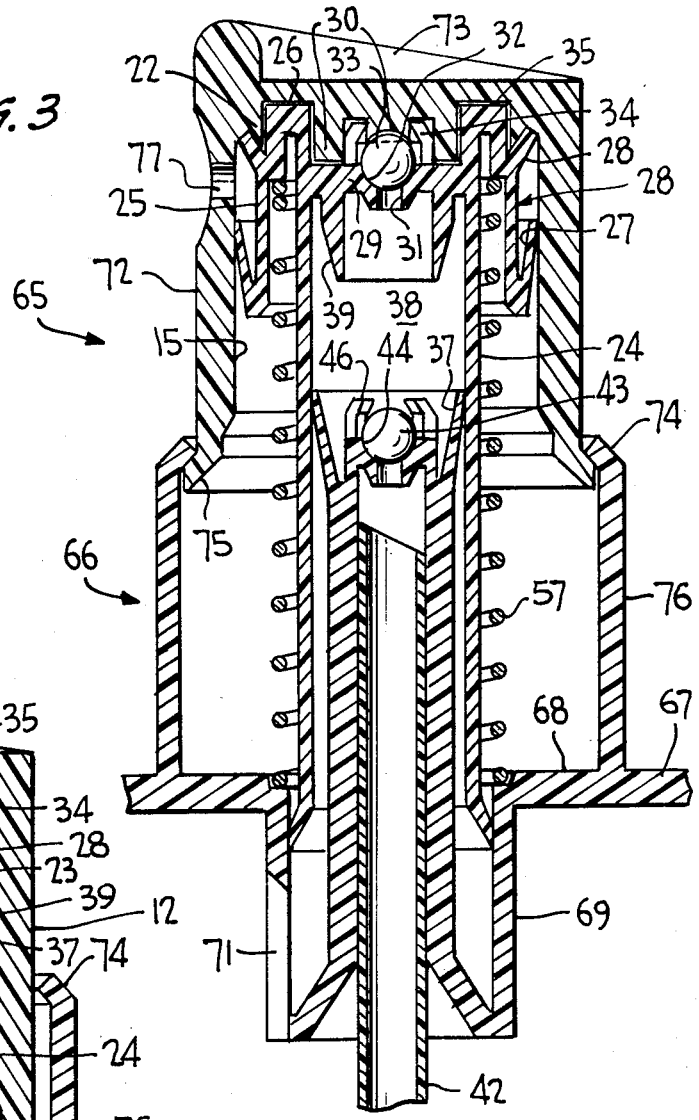
FIG. 3 is a vertical sectional view of a dispenser according to another embodiment of the invention, the pump elements being shown in their at rest position prior to finger actuation.
Figure 4:
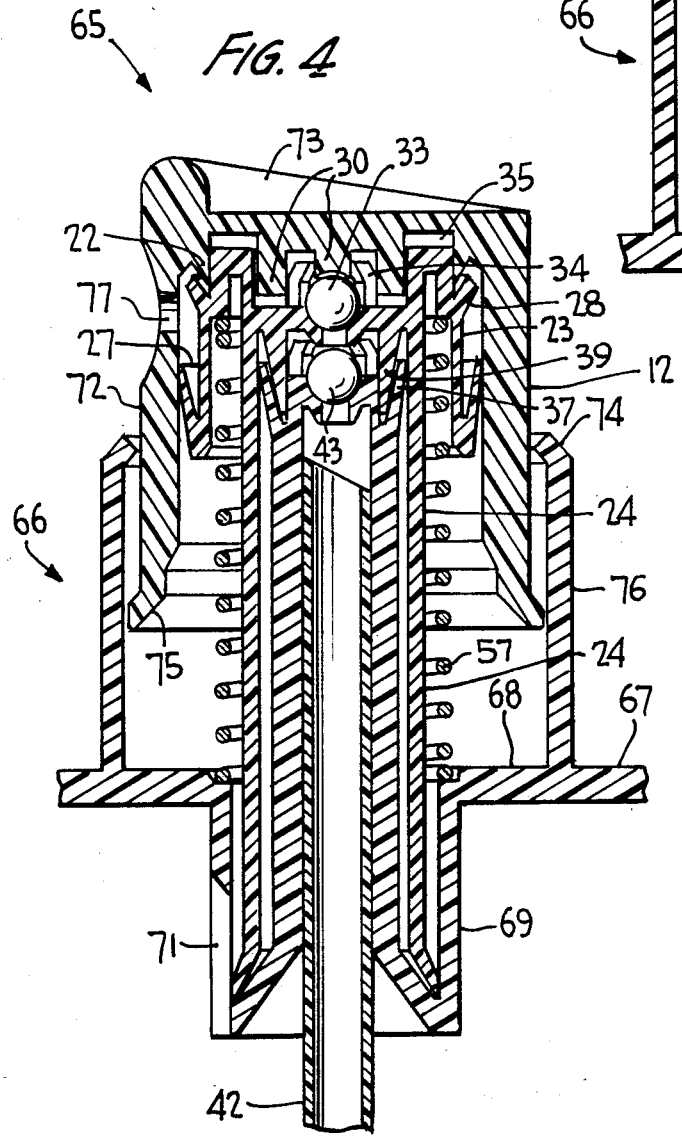
FIG. 4 is a view similar to FIG. 3, in which the plunger/accumulator is shown at or near the end of its compression stroke with the intake valve closed and the discharge open to effect continuous discharge.

The finger actuated dispenser according to another embodiment of the invention is generally designated 65 in FIGS. 3 and 4 and is structured similar to that of dispenser 10 except that the piston is stationary and a plunger head is reciprocated thereon by finger actuation. Similar elements to that of dispenser 10 will therefore be designated by like reference numerals.

Dispenser 65 comprises a pump body 66 which includes an integral cap 67 (only partially shown) adapted for securing the pump body over the opening of a container (not shown) of flowable product to be dispensed.

The pump body includes a shoulder 68 from which a cylindrical wall 69 depends. This wall surrounds and is slightly spaced from upstanding piston 36 which is stationary and which is affixed thereto. A container vent opening 71 is located in a lower portion of wall 69 to permit equalization of pressure within and outside the container, similar to that described in U.S. Pat. No. 4,402,432, so as to replace the product dispensed from the container with air to avoid collapse of the container and a pressure lock condition within the pump. Accumulator 23 functions as a plunger/accumulator and includes a tubular sleeve 24 of longer extent as compared to that of FIG. 1, sleeve 24 encircling and cooperating with the stationary piston as a pump cylinder and being reciprocable thereon to define therewith variable volume pump chamber 38. Return spring 57 extends between shoulder 68 and an underside portion of the accumulator for resiliently urging the accumulator, and a surrounding plunger head 72, upwardly toward the fully raised position of FIG. 3 and normally maintaining that position at rest.

Plunger head 72 includes the downwardly directed blind socket 21 which snugly and slidably receives accumulator 23 and defines therewith the enclosed variable volume accumulation chamber 35, and the underside of the plunger head confronting the accumulator is structured the same as that described for such confronting portion of the pump body of the FIG. 1 embodiment.

The plunger head is formed at its upper end as having a finger piece 73 so that intermittent finger pressure conveniently applied to it may be transmitted to the accumulator for producing reciprocation thereof on the stationary piston, each depression of the accumulator being yieldably resisted by spring 57 which will return the accumulator to its fully raised position following each withdrawal of finger pressure.

Upward movement of the plunger head is positively limited by any suitable means such as annular cooperating stop shoulders or ribs 74, 75, respectively provided on sleeve 24 and on an upstanding cylindrical wall 76 on the pump body. These stop shoulders, as in U.S. Patent 4,402,432, need not sealingly engage one another in the raised position of the plunger head of FIG. 1.

A discharge orifice 77 defining a discharge passage extends through the wall of the plunger head and is adapted to convey the dispensed product from the accumulation chamber into the atmosphere through a suitable discharge nozzle (not shown). The remainder of pump 65 is structured substantially similar to that described for dispenser 10 of the FIGS. 1 and 2 embodiment.

Figure 5:
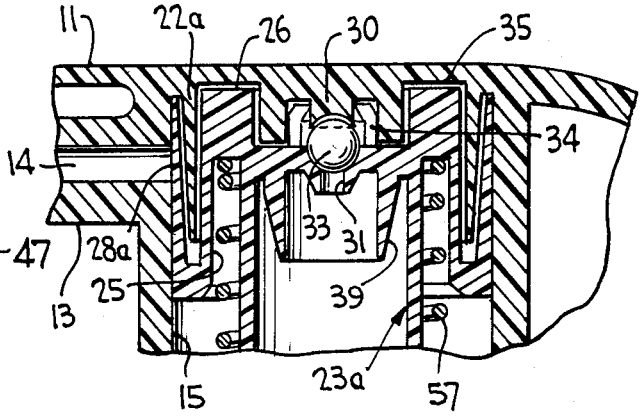
FIG. 5 is a partial view similar to FIGS. 1 and 3 of a dispenser according to a further embodiment of the invention.

The embodiment according to FIG. 5 is essentially the same as that of FIGS. 1 and 3 except that provision is made for a comparatively slower discharge opening. Accumulator element **23*a* includes a discharge valve flange 28*a* having its terminal end in sealing engagement with wall 15 and lying slightly above the discharge passage. Thus, as will be described more fully hereinafter, the discharge opens only as the terminal end of flange 28*a* clears a portion of passage 14, during the relative shift between the accumulator and the head. Other parts of the FIG. 5 embodiment are the same as FIGS. 1 and 3 except for annular rib 22*a* having a longer extent. And, the FIG. 5 arrangement is readily adaptable to the trigger dispenser of FIG. 1 and to the finger dispenser of FIG. 3**.

MODE OF OPERATION

With the parts of dispenser 10 and dispenser 65 at the rest position of FIG. 1 and of FIG. 3, any air in the pump and accumulation chambers may be substantially purged from the dispenser by pulling back on the trigger, in the direction of the arrow of FIG. 1, or by depressing plunger head 72, to thereby compress the plunger so that the compressed air in the pump chamber unseats ball check valve 33 and is admitted into the accumulation chamber whereupon the compressed air acts on the larger diameter accumulation chamber to urge the accumulator toward the FIGS. 2, 4 position. Because of check valve 33 successive air pumping plunger strokes increase accumulator air pressure. Discharge valve 28 thereof is thus slightly moved away from sealing rib 22 sufficiently to bleed off the compressed air through passage 14. Since valve flange 28 is spaced from the discharge passage, the discharge valve seat acting between rib 22 and valve flange 28 alone separates the accumulation chamber from the discharge passage, and only a slight relative shifting between the accumulator and the piston opens the discharge thus effecting a quick opening discharge for the FIGS. 1 and 3 embodiments. Otherwise, in the FIG. 5 arrangement in which valve flange 28a seals the discharge closed with its terminal end lying above the discharge passage, the accumulator must shift to a greater extent relative to the blind socket until the terminal end of flange 28a clears at least a portion of discharge passage 14. Thus, the discharge passage is opened more slowly compared to that shown in FIGS. 2 and 4.

During the compression stroke, ball check valve 43 prevents any fluid in the pump chamber from entering the container through the dip tube, since the intake valve closes the intake during the plunger compression stroke. Repeated reciprocation injects some product and expels some air until fully primed. The complementarily contoured surfaces between the pump body (FIG. 1) or plunger head (FIG. 3) and the confronting accumulator separator wall, and between such wall and the confronting piston, permit air to be substantially evacuated from both chambers, as these respective contoured surface pairs contact. The plunger may at all times be compressed until the contour of extension 39 makes contact or near contact with the matching contour at the upper end of the plunger. Since the upper end of the accumulator matches the facing contour of the bore, the accumulation chamber volume is at a minimum, resulting in a high compression ratio between plunger swept volume and the net clearance volume with the plunger fully compressed. Air compressed on the initial stroke is fully transferred into the accumulation chamber and is prevented from expanding back into the pump chamber during successive compression strokes by the accumulator check valve 33, enhancing the purging of air from the discharge valve. During priming, accumulated air is thus effectively squeezed out of both chambers before commencement of the normal dispensing operation.

Subsequent reciprocation or reciprocations of the pump plunger functions to prime the pump by expelling air from the chambers as aforedescribed and by suctioning flowable product upwardly through the dip tube and the inlet passage and into the pump chamber due to the reduced pressure in the pump chamber relative to atmospheric pressure in the container acting on the product contained therein.

During the initial compression stroke of the plunger, effected upon pulling back on the trigger in the direction of the arrow of FIG. 1, or upon depressing the FIG. 3 plunger head, spring 57 is compressed and, as the compression stroke continues, the pressure within the pump and accumulation chambers will progressively increase, as product enters the accumulation chamber through the unseated check valve 33, and will create a downward hydraulic force on the upper end of the accumulator within the larger diameter accumulation chamber. When this downward force is sufficient to overcome the counter-balancing force of the spring, the accumulator will be displaced downwardly to its open position of FIGS. 2, 4 whereby product stored in the accumulation chamber will be discharged under pressure therefrom through discharge passage 14 (FIG. 1), or through discharge orifice 77 (FIG. 3), with discharge valve 28 moved away from sealing rib 22. During this discharge open condition, check valve 33 is operative for blocking return flow of product from the accumulation chamber back into the pump chamber, so that discharge from the accumulation chamber will continue so long as the pressure of product therein is sufficient to maintain the accumulator displaced downwardly in a discharge open position, even during the time when the pump plunger is released to begin its suction stroke under the restoring force of the return spring, and even after the plunger is started to be actuated again. And, as in the dispenser according to my related application and my 4,402,432 patent, sustained discharge may be influenced by the selection of a predetermined spring tension and the provision of a sufficiently large diameter for the accumulation chamber relative to that of the pump chamber so that, upon drawing back quickly on the trigger, or upon quickly depressing the plunger head, the quick accumulation of fluid under pressure acting in chamber 35 will be more slowly displaced against the return spring, as it maintains the regulated pressure against the discharge nozzle until chamber 35 is purged. However, in accordance with the present invention, so long as sufficient pressure is maintained in the accumulation chamber, which is blocked by the one-way check valve 33 from returning to the pump chamber, the pump plunger may be released upon a letting up upon the trigger in a direction opposite the arrow shown in FIG. 2, or upon a release of downward pressure on the FIG. 3 plunger head, and even after the pumping action is restarted, so long as the pressure in the accumulation chamber is not overcome by the restoring force of the return spring.

The spring pressure will tend to reseat the accumulator within the socket at the upper end of body section 12 so as to again close off the discharge by outlet valve 28, maintaining regulated pressure within the accumulation chamber with the discharge passage open, to discharge the contents of the accumulation chamber. If the accumulator is recharged from the pump chamber before the discharge is closed, then continuous constant pressure discharge results. Thus, upon release of the trigger or the plunger head at any point in the compression stroke, the discharge valve will remain open for such time as the volume in the accumulation chamber is discharged by the force of the spring on the accumulator. And, this release will, as usual, effect an increase in volume in the pump chamber and accordingly decrease its pressure so as to suction a new charge of product into the compression chamber.

Because of the unique arrangement of the present pumps wherein the accumulator operates within a larger diameter accumulation chamber as compared to the encircled smaller diameter pump chamber in which the piston operates, upon a relatively rapid actuation of the pump plunger, the piston may be caused to bottom out at the inner end of the pump cylinder whereupon confronting contoured surfaces between the underside of the accumulator-valved separator wall and the piston are in contact or near contact to thereby empty the pump chamber. In such a condition, the hydraulic pressure of product within the accumulation chamber is overcome not by the force of the return spring, alone, but is boosted by the manual compression of the piston and accumulator which are operated together as a unit. Thus, product may be expelled from the accumulation chamber at a pressure greater than that which would be provided solely by the return spring force. This feature of the present dispensers is effective for expelling product through a sticky or clogged discharge orifice or swirl chamber, owing to the specific type product to be dispensed. Thus, if the discharge orifice is fully or partially blocked with dried product, the high pressure manually exerted against the product in the accumulation chamber will restore proper discharge.

And, similarly as described with reference to the aforementioned related application, the guide and venting functions at the inner end of the pump plunger are the same for the FIG. 1 embodiment, as well as the anti-spill function. Moreover, all the other advantages achieved by my prior aforementioned dispensers are capable of the present dispensers.

From the foregoing it can be seen that a manually operated dispenser has been devised with a minimum number of operating parts for simple operation and production, without leakage, and capable of economical production and assembly. The dispenser is capable of discharging product in a continuous, non-pulsating spray or stream by the provision of coaxial pressurized pump and accumulation chambers separated by a one-way valve-controlled opening. The piston operates within an encircling sleeve of an accumulator element and defines therewith a pressurized pump chamber, the accumulator including a discharge valve and operating within a larger diameter accumulation chamber defined between an upper end of the accumulator and a confronting end of the pump bore. A capped end of the accumulator includes a valve controlled opening through which product is forced during the plunger compression stroke from the pump chamber to the accumulation chamber for opening the discharge as the accumulator shifts away from its confronting end of the pump body as the accumulation chamber pressure exceeds the force of a return spring acting between the accumulator and the plunger. A single return spring may be provided for restoring the plunger following actuation and for spring biasing the accumulator element against the discharge opening force effected upon an increase in accumulation chamber pressure. In the discharge open mode, discharge of product continues until the accumulator volume is dispensed and the force of the return spring maintaining accumulation chamber pressure until the discharge valve is closed, one-way valving on the accumulator preventing return flow at any time to the pump chamber. The plunger may, therefore, be released during discharge and reactuated before the discharge valve is closed. The accumulation chamber is defined between the upper end of the accumulator and a confronting and matching contoured blind socket end of the pump body or discharge head bore. And, the contour at the upper end of the piston matches the contour at the confronting underside of the accumulator such that, during a relatively rapid pumping action during which the piston bottoms out in the pump cylinder, the pump chamber may be essentially emptied such that the piston and accumulator may be operated together as a unit for the manual pumping of product from the accumulation chamber through the open discharge.

Otherwise, when not in use, both the discharge and the container vent are automatically sealed closed by the return spring in essentially the same manner as described with reference to my aforementioned related application and my 4,402,432 patent. And, the telescoping skirt depending from the plunger of dispenser 10 functions not only as a plunger guide but as a spill guard and forms a sump area for controlling leakage and seepage of product through the container vent aided by the piston type action against the interior of the container.

Moreover, it should be recognized that the continuous discharge dispenser of the invention can be converted into a manually operated dispenser of the type set forth in my aforementioned U.S. application Ser. No. 539,965, by simply eliminating ball check valve 33. Dispensing is thus effected in a manner described in detail in my 539,965 application.

Obviously, many modifications and variations of the present invention are made possible in the light of the above teachings. It is therefore to be understood that within the scope of the appended claims the invention may be practiced otherwise than as specifically described.

What is claimed is:

1. A dispenser comprising:

a pump body having an inwardly directed blind socket at one end;

means at the other end of said pump body for securing same in fluid tight communication with the opening of a container of flowable product to be dispensed;

an accumulator slidably disposed in said body and defining a variable volume pressure accumulation chamber with said blind socket;

a plunger having a piston portion slidably disposed in said accumulator and therewith defining a variable volume pump chamber in communication with said accumulation chamber which receives pressurized product from said pump chamber;

a discharge passage opening outwardly from said accumulation chamber;

said accumulator having an outlet valve thereon for opening said passage upon movement of said accumulator in one direction in response to an accumulation of pressure in said accumulation chamber, said outlet valve closing said passage upon movement of said accumulator in an opposite direction;

means on said accumulator defining a check valve controlled inlet from said pump chamber and for blocking return flow to said pump chamber, whereby the dispensing of product upon said opening of said passage continues so long as the pressure in said accumulation chamber maintains said outlet valve open;

said plunger having a check valve controlled inlet passage therethrough for establishing communication between said pump chamber and the container of flowable product to be dispensed;

resilient means urging said accumulator for movement in said opposite direction; and means for actuating said plunger, independently of the movement of said accumulator, between piston pressure and intake strokes.

2. The dispenser according to claim 1, wherein said blind socket includes an annular sealing rib depending from said one end of said pump body, and said outlet valve comprising an annular valve flange in engagement with said rib for closing said discharge passage, said valve flange being spaced from said passage so as to define a quick acting discharge valve.

3. The dispenser according to claim 1, wherein said blind socket includes an annular sealing rib depending from said one end of said pump body, and said outlet valve comprising an annular valve flange in engagement with said rib and covering said discharge passage for closing same, so as to thereby define a slow acting discharge valve.

4. The dispenser according to claim 1, wherein said one end of said pump body includes an annular discharge valve seat, said discharge passage extending away from said seat and said outlet valve being conformed for sealing engagement with said valve seat.

5. The dispenser according to claim 1, wherein said resilient means acts between said plunger and said accumulator for biasing them apart and for returning said plunger toward a rest position.

6. The dispenser according to claim 5, wherein said resilient means comprises a single coil spring.

7. The dispenser according to claim 1, wherein said piston portion and an opposing surface of said means on said accumulator are complementarily contoured so that said pump chamber may be effectively primed as any air within said pump chamber is substantially evacuated through said discharge passage upon actuation of said plunger, and so that said plunger and said accumulator may be operated as a unit for overcoming pressure within said accumulation chamber upon plunger actuation to thereby expel product therefrom.

8. The dispenser according to claim 7, wherein said pump body at said one end thereof and an opposing surface of said means on said accumulator are complementarily contoured so that any air from therebetween may be substantially purged during priming.

9. The dispenser according to claim 1, wherein said other end of said pump body has an annular rim thereon defining a vent valve seat, at least one vent passage extending between opposite sides of said rim, and a vent valve on said plunger engageable with said vent valve seat at the end of said piston intake stroke.

10. The dispenser according to claim 9, wherein said resilient means operates for urging said piston and said accumulator for said relative movement away from one another.

11. The dispenser according to claim 10, wherein said resilient means comprises a single coil spring.

12. In a manually operated dispenser for continuously dispensing product from a container, comprising:

a pump body having means thereon adapted to secure said body in fluid tight communication with the opening of the container;

a pump piston and a pump cylinder together defining a variable volume pump chamber and being relatively movable toward one another during a compression stroke for pressurizing product therein, and relatively away from one another during a suction stroke for suctioning product from the container into said pump chamber;

means defining a variable volume pressure accumulation chamber for receiving a pressurized product from said pump chamber during said compression stroke;

means defining a discharge passage opening outwardly from said accumulation chamber;

an accumulator mounted for reciprocation on said piston and having means thereon operable to open and close said discharge passage during said reciprocation;

said accumulator including said pump cylinder which is coaxially aligned with said piston;

means defining an inwardly directed blind socket, said discharge passage extending outwardly of said blind socket;

said accumulator, together with said blind socket, defining said accumulation chamber;

wall means on said accumulator defining a check valve controlled inlet from said pump chamber and for blocking return flow to said pump chamber, whereby the dispensing of product upon the opening of said passage continues so long as the pressure in said accumulation chamber maintains said discharge passage open; and resilient means urging said accumulator into a position closing said discharge passage.

13. The dispenser according to claim 12, wherein said means defining said blind socket includes an annular, depending sealing rib, and said means on said accumulator operable to open and close said discharge passage comprising an annular valve flange in engagement with said rib for closing said passage, said valve flange being spaced from said passage so as to define a quick acting discharge valve.

14. The dispenser according to claim 12, wherein said means defining said blind socket includes an annular, depending sealing rib, and said means on said accumulator operable to open and close said discharge passage comprising an annular valve flange in engagement with said rib and covering said discharge passage for closing same, so as to thereby define a slow acting discharge valve.

15. The dispenser according to claim 12, wherein said piston comprises a plunger movable within said pump chamber, and means are provided on said pump body for actuating said plunger.

16. The dispenser according to claims 12, wherein a plunger head is mounted for reciprocation on said pump body and contains said reciprocable accumulator, and said piston is fixedly mounted on said pump body, whereby said pump cylinder is movable on said piston upon actuation of said plunger head.

17. The dispenser according to claim 12, wherein said piston and an opposing surface of said wall means on said accumulator are complementarily contoured to effect priming as any air within said pump chamber is substantially evacuated through said open discharge passage upon said compression stroke, and to facilitate operation of said piston and said accumulator as a unit for overcoming during said compression stroke the pressure within said accumulation chamber to expel product therefrom.

18. The dispenser according to claim 17, wherein said wall means on said accumulator confronts said means defining said blind socket and are complementarily contoured to effect priming as any air therebetween is substantially evacuated through said open discharge passage upon said compression stroke.

19. The dispenser according to claim 18, wherein said accumulator has a shoulder contoured to match said means defining said blind socket for purging any air in said accumulation chamber through said open discharge passage.

* * * * *